US007164307B2

(12) United States Patent
Tschanz et al.

(10) Patent No.: US 7,164,307 B2
(45) Date of Patent: Jan. 16, 2007

(54) BIAS GENERATOR FOR BODY BIAS

(75) Inventors: James W. Tschanz, Portland, OR (US); Stephen H. Tang, Pleasanton, CA (US); Victor Zia, Beaverton, OR (US); Badarinath Kommandur, Hillsboro, OR (US); Siva G. Narendra, Portland, OR (US); Vivek K. De, Beaverton, OR (US)

(73) Assignee: Intel Corporation, Santa Clara, CA (US)

( * ) Notice: Subject to any disclaimer, the term of this patent is extended or adjusted under 35 U.S.C. 154(b) by 78 days.

(21) Appl. No.: 11/038,134

(22) Filed: Jan. 21, 2005

(65) Prior Publication Data

US 2006/0164157 A1 Jul. 27, 2006

(51) Int. Cl.
*G05F 1/10* (2006.01)

(52) U.S. Cl. ..... 327/534; 327/536; 327/537

(58) Field of Classification Search ..... 327/530, 327/534, 535, 536, 537, 538, 539, 540, 541, 327/542, 543

See application file for complete search history.

(56) References Cited

U.S. PATENT DOCUMENTS 5,557,231 A * 9/1996 Yamaguchi et al. ..... 327/534
6,218,895 B1 * 4/2001 De et al. ..... 327/566
6,366,156 B1 * 4/2002 Narendra et al. ..... 327/534
6,448,840 B1 * 9/2002 Kao et al. ..... 327/534
6,469,572 B1 * 10/2002 Bruneau et al. ..... 327/537
6,774,665 B1 * 8/2004 Amick et al. ..... 326/30
6,885,234 B1 * 4/2005 Ando ..... 327/534
7,030,681 B1 * 4/2006 Yamazaki et al. ..... 327/534

OTHER PUBLICATIONS

James W. Tschanz et al. "Adaptive Body Bias for Reducing Impacts of Die-to-Die and Within-Die Parameter Variations on Microprocessor Frequency and Leakage;" IEEE Journal of Solid-State Circuits, vol. 37, No. 11, Nov. 2002; pp. 1396-1402.

Stefanos Sidiropoulos et al., "A Semidigital Dual Delay-Locked Loop;" IEEE Journal of Solid-State Circuits, vol. 32, Nol. 11, Nov. 1997; pp. 1683-1692.

John G. Maneatis; Low-Jitter Process-Independent DLL and PLL Based on Self-Biased Techniques; IEEE Journal of Solid-State Circuits, vol. 31, No. 11, Nov. 1996; pp. 1723-1732.

David J. Foley et al., "A 3.3V, 1.6GHz, Low-Jitter, Self-Correcting DLL Based Clock Synthesizer in 0.5 μm CMOS;" IEEE International Symposium on Circuits and Systems, May 28-31, 2000, Geneva, Switzerland, pp. II-249-II-252.

* cited by examiner

*Primary Examiner*—Timothy P. Callahan
*Assistant Examiner*—Hai L. Nguyen
(74) *Attorney, Agent, or Firm*—Fleshner & Kim, LLP

(57) ABSTRACT

A bias generator unit is provided that includes a central bias generator to provide a bias voltage, a local bias generator to receive the bias voltage and a reference voltage and to provide a forward body bias signal or a reverse body bias signal. The bias generator may include a charge pump to output (or provide) a reference voltage to a reference generator, which in turn provides reference signals to the central bias generator. As a result, the local bias generator may control the body bias signal provided by the local bias generator.

27 Claims, 9 Drawing Sheets

BIAS GENERATOR FOR BODY BIAS

FIELD

Embodiments of the present invention may relate to signal generators. More particularly, embodiments of the present invention may relate to the generation of body bias signals for driving circuits.

BACKGROUND

Adaptive body bias may be used after fabrication to improve a bin split in processors and to reduce a variation in frequency and leakage caused by process variations. In performing adaptive body bias, a unique body bias voltage may be set to maximize the frequency of the processor subject to leakage and total power constraints and the type of transistor technology in use. Body bias voltages may be applied to processors and other circuits that use P-type metal oxide semiconductor (PMOS) transistors, N-type metal oxide semiconductor (NMOS) transistors, or both.

Two types of body bias voltages may be used to control the frequency of a processor, namely forward body bias (FBB) voltages and reverse body bias (RBB) voltages. A forward body bias (FBB) voltage may reduce a threshold voltage of transistors, increase a drive current and increase circuit speed. At the same time, forward body bias may improve short-channel effects of the transistors. On the other hand, a reverse body bias (RBB) voltage may increase the threshold voltage, reduce the speed and also reduce the leakage current of the transistors. Body bias may therefore be used to control standby leakage of a processor while at a same time obtaining a maximum speed during active mode.

Body bias may be applied to either NMOS or PMOS transistors, or both. Applying body bias to NMOS transistors in a non-triple well process may present additional complexities since voltages lower than 0 volts may be required and the body of the NMOS devices (i.e., the p-substrates) may be shared among the transistors. Therefore, if a body bias higher than 0 volts is applied, any transistor coupled to a negative voltage may become forward biased by a large amount and may cause functionality and/or power consumption problems.

The circuitry for applying adaptive body bias may include two blocks, namely a central bias generator (CBG) and a local bias generator (LBG). The central bias generator may generate a reference voltage that is process, voltage and temperature independent. This voltage may represent the desired body bias to apply to NMOS and/or PMOS transistors in the processor core or other locations.

On the other hand, many local bias generators may be distributed throughout a processor die. The local bias generators may translate the reference voltage from the CBG into local block supply voltages and then drive these voltages to the transistors or other devices in each respective block. The translation may ensure that if a local block supply voltage changes, the body bias will change at substantially a same time so that a constant bias is maintained. For example, for NMOS body bias, the body voltage may track variations in a local block ground (Vss). On the other hand, for PMOS body bias, the body voltage may track variations in a local block voltage (Vcc). The LBGs may also provide drive strength to meet impedance requirements and minimize noise on transistor bodies.

BRIEF DESCRIPTION OF THE DRAWINGS

The foregoing and a better understanding of the present invention may become apparent from the following detailed description of arrangements and example embodiments and the claims when read in connection with the accompanying drawings, all forming a part of the disclosure of this invention. While the foregoing and following written and illustrated disclosure focuses on disclosing arrangements and example embodiments of the invention, it should be clearly understood that the same is by way of illustration and example only and the invention is not limited thereto.

The following represents brief descriptions of the drawings in which like reference numerals represent like elements and wherein.

DETAILED DESCRIPTION

Figure 1:
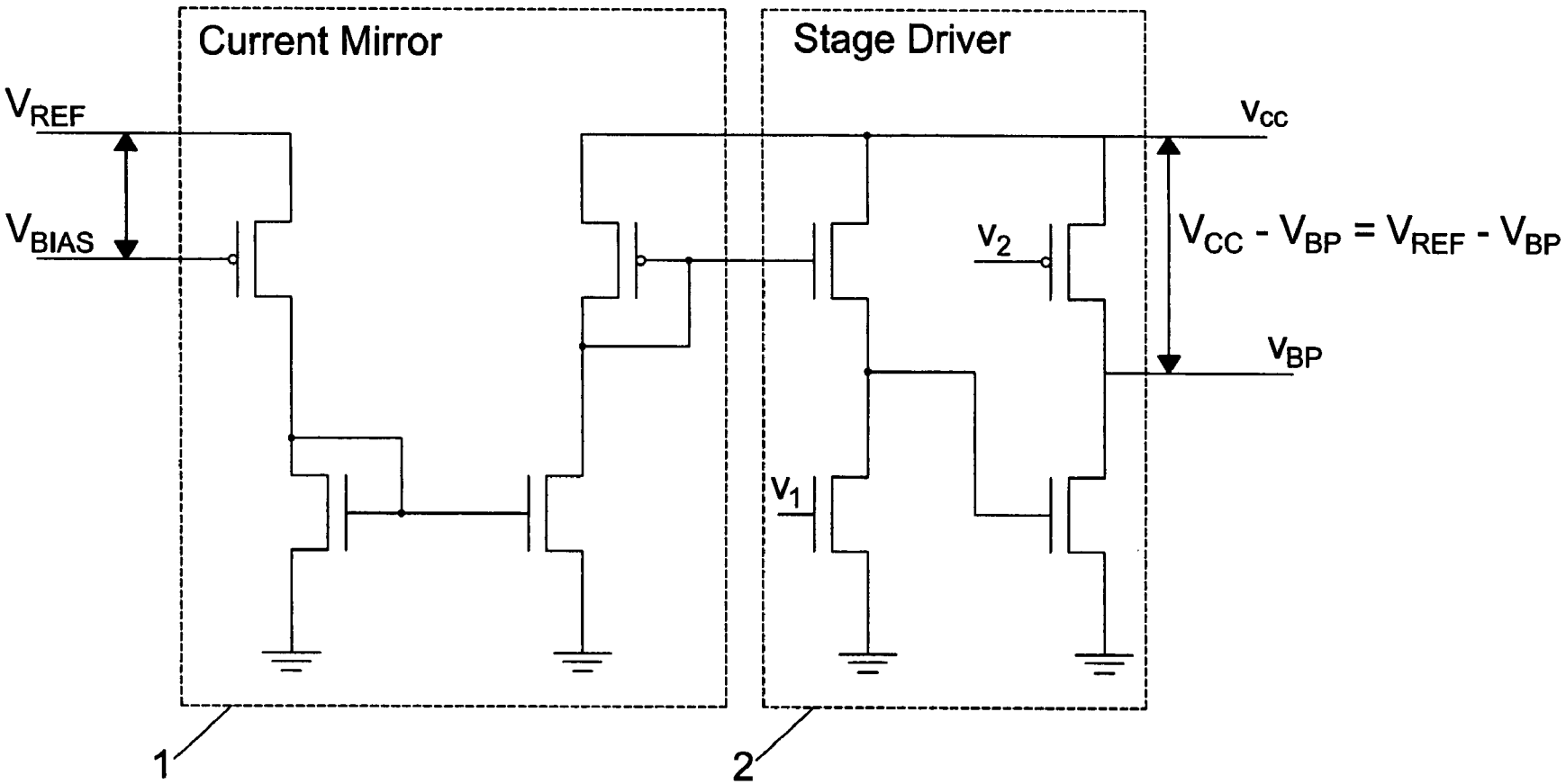
FIG. 1 shows a local bias generator according to an example arrangement.

In the following detailed description, like reference numerals and characters may be used to designate identical, corresponding or similar components in differing figure drawings. Further, in the detailed description to follow, example sizes/models/values/ranges may be given although the present invention is not limited to the same. Well-known power/ground connections to integrated circuits (ICs) and other components may not be shown within the FIGs. for simplicity of illustration and discussion. Further, arrangements and embodiments may be shown in block diagram form in order to avoid obscuring the invention, and also in view of the fact that specifics with respect to implementation of such block diagram arrangements may be dependent upon the platform within which the present invention is to be implemented. That is, the specifics are well within the purview of one skilled in the art. Where specific details are set forth in order to describe example embodiments of the invention, it should be apparent to one skilled in the art that the invention can be practiced without these specific details.

Further, arrangements and embodiments may be described with respect to signal(s) and/or signal line(s). The identification of a signal (or signal line) may correspond to a single signal (or a single signal line) or may be a plurality of signals (or plurality of signal lines). Additionally, the terminology of signal(s) and signal line(s) may be used interchangeably. A signal(s) may also be described as a voltage(s) such as on a signal line. Further, while values or signals may be described as HIGH ("1") or LOW ("0"), these descriptions of HIGH and LOW are intended to be relative to the discussed arrangement and/or embodiment. That is, a value or signal may be described as HIGH in one arrangement although it may be LOW if provided in another arrangement, such as with a change in logic. The terms HIGH and LOW may be used in an intended generic sense. Embodiments and arrangements may be implemented with a total/partial reversal of the HIGH and LOW signals by a change in logic.

Embodiments of the present invention may provide a bias generator (or bias generator unit) that includes a central bias generator, a local bias generator and a charge pump that allows a forward body bias and a reverse body bias to be applied to NMOS and PMOS transistors.

FIG. 1 shows a local bias generator according to an example arrangement. The type and complexity of a local bias generator may depend on whether forward body bias, reverse body bias, or both will be applied. Other arrangements are also possible. If only forward body bias is applied, then the local body bias generator shown in FIG. 1 may be used, for example. More specifically, FIG. 1 shows a LBG that may include two stages. The first stage may include a current mirror 1 that translates a voltage $V_{BIAS}$ from a CBG (not shown) referenced to a voltage $V_{REF}$ (also not shown) into a voltage which is referenced to the local block $V_{CC}$. The second stage may be a two-stage source-follower circuit (or stage driver) 2 that provides drive strength to supply body bias voltage $V_{BP}$ to the local block. The circuit may operate so that the output differential voltage ($V_{CC}-V_{BP}$) always equals (or substantially equals) the input differential voltage ($V_{REF}-V_{BIAS}$).

However, the arrangement shown in FIG. 1 may lose tracking as an input differential becomes small. This may occur because the transistors in the current mirror 1 as well as the output stage fall out of saturation as the desired bias becomes smaller. Additionally, the multiple-circuit stages used to implement the local bias generator may consume larger chip area and cause the bias generator to consume considerable static power.

Another type of bias generator may include an operational amplifier structure in a feedback configuration. This circuit may operate from a higher supply voltage than the local block $V_{CC}$ and may be able to apply any bias value from forward body bias to reverse body bias. Tracking with the local $V_{CC}$ may be automatically performed through the feedback structure. While this circuit may not have all the drawbacks of the design shown in FIG. 1, its implementation may consume an even larger chip area and require an even higher supply voltage for the amplifier. This design may therefore be considered suitable when both forward body bias and reverse body bias needs to be applied.

Figure 2:
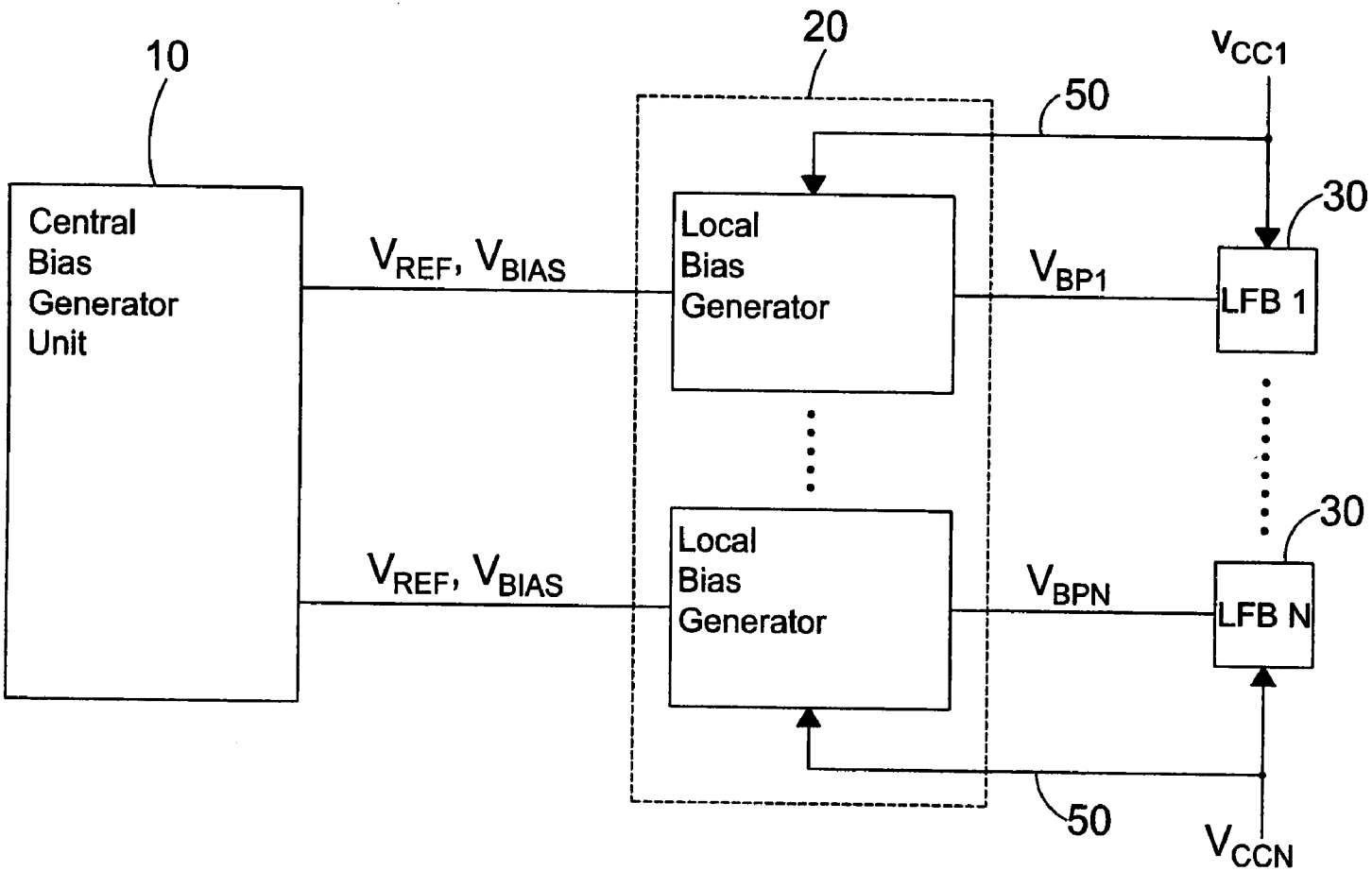
FIG. 2 shows a bias generator according to an example arrangement.

FIG. 2 shows a bias generator according to an example arrangement. Other arrangements are also possible. More specifically, the bias generator may include a central bias generator unit 10 and a local bias generator unit 20. The local bias generator unit 20 may be coupled to one or more circuits 30 located on or off the same chip (or die) on which the generator units are located. These circuits, generally referred to as local functional blocks (LFBs), may include one or more transistors that operate as switches or amplifiers or perform any other function. The local functional blocks may be coupled to one another such that the output of one block serves as the input into one or more other blocks, the blocks may be separately situated to generate signals for performing independent tasks, or a combination of the two is possible.

The central bias generator unit 10 may generate reference and bias voltages ($V_{REF}$, $V_{BIAS}$) that are used in deriving local biasing voltages for each of the functional blocks. These voltages may be generated in a manner that is process, voltage, and temperature independent.

The central bias generator unit 10 may be configured to generate one or more reference and body bias voltages based on the requirements of the intended application of the chip or host system and the type of transistor technology used in the local functional blocks. In terms of relative placement, the central bias generator unit 10 may be located on the same chip as the local bias generators or the central bias generator unit 10 may be located off-chip.

Figure 3:
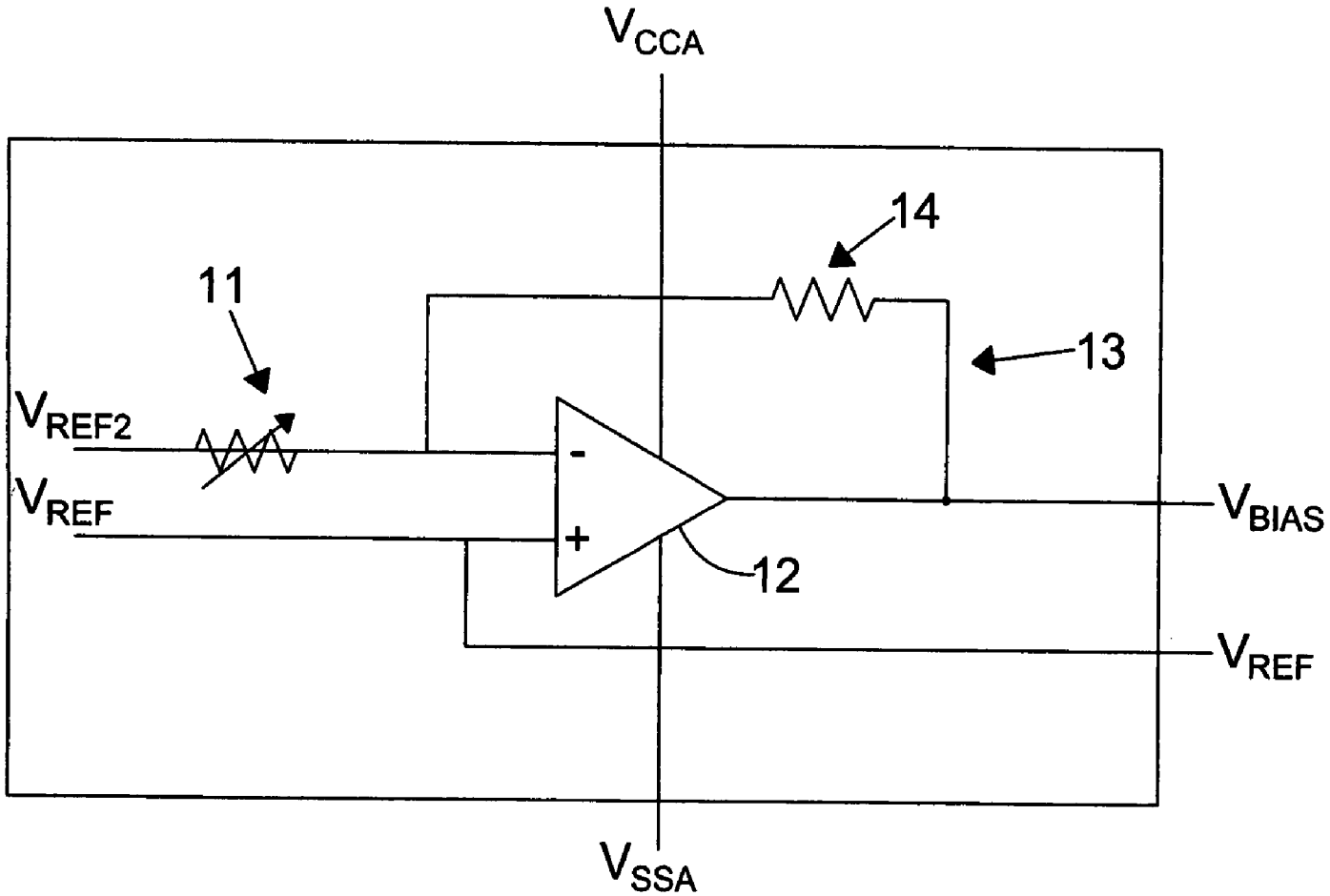
FIG. 3 shows a central bias generator according to an example arrangement.

FIG. 3 shows a central bias generator according to an example arrangement. Other arrangements are also possible. This central bias generator may include a variable resistor 11, an operational amplifier 12, and a feedback path 13 that includes a resistor 14. The variable resistor 11 may, for example, be formed from an R-2R resistor network coupled to input a variable reference voltage $V_{REF2}$ into an inverting terminal of the amplifier 12. A fixed reference voltage $V_{REF}$ may be input into a non-inverting terminal. The amplifier 12 may be driven by supply voltages $V_{CCA}$ and $V_{SSA}$. The feedback path 13 may include the resistor 14 that determines the output bias voltage in combination with the variable resistor 11 in accordance with the following equation: $V_{BIAS}=V_{REF2}-(R_{FBK}/R_{VAR})(V_{REF2}-V_{REF})$, where $R_{FBK}/R_{VAR}$ is a ratio of the feedback and variable resistances.

In operation, the output of the variable resistor 11 may set the bias voltage $V_{BIAS}$ generated by the CBG unit. As this resistance changes, the bias voltage $V_{BIAS}$ changes relative to the fixed reference voltage $V_{REF}$. The bias and reference voltages are then output to the local bias generators such as shown in FIG. 2, for example. One skilled in the art can appreciate that this circuit shows one possible configuration of a central bias generator that may be included in the unit 10, and that other types of CBGs may also be used.

The local bias generator unit 20 may include one or more local bias generators, each of which may include a single-stage circuit that operates to ensure that a constant bias voltage (e.g., $V_{BP1}$ or $V_{BPN}$ as shown in FIG. 2) is supplied to a respective one of the local functional blocks (LFBs).

Figure 4:
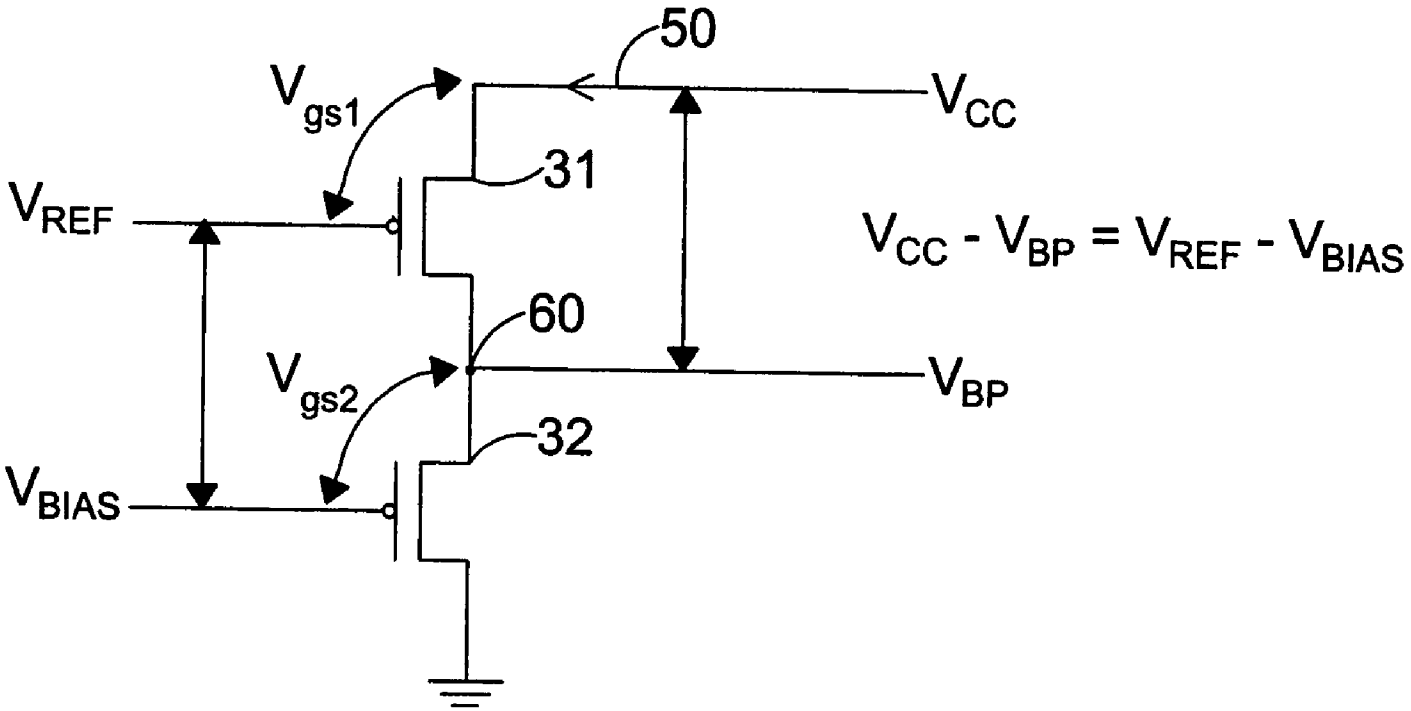
FIG. 4 shows a local bias generator according to an example arrangement.

FIG. 4 shows a local bias generator according to an example arrangement. Other arrangements are also possible. More specifically, the local bias generator may include an amplifier that preferably has unity gain and generates an output signal that "follows" its input signal. In the example arrangement shown, the amplifier is in the form of a single-stage source-follower (buffer) circuit. This circuit may include two field-effect (FET) transistors 31 and 32. The drain of the transistor 31 is coupled to the source of transistor 32, the drain of the transistor 32 is coupled to a reference potential, and the gates of the transistors 31, 32 respectively receive the reference voltage $V_{REF}$ and the bias voltage $V_{BIAS}$ output from the central bias generator unit. The reference voltage (or potential) may be ground or some other value.

As shown in FIG. 2, each local functional block may be powered by a respective supply voltage $V_{CC1}$ through $V_{CCN}$, where N equals the number of functional blocks. These supply voltages may be input into corresponding ones of the local bias generators along a signal line(s) 50 that is coupled to the source of the transistor 31. As shown in FIG. 4, a node 60 may output a bias voltage $V_{BP}$. The single-stage source-follower circuit may provide adaptive body bias by constantly adjusting the bias voltage $V_{BP}$ to track variations in parameters.

However, applying reverse body bias to NMOS transistors in a standard (non-triple-well) process may involve additional complexities since voltages lower than 0 volts may be required and NMOS transistors may have their bodies (i.e., the p-substrate) shared by all the transistors on the processor die. Therefore, if a body bias higher than 0 volts is applied, any transistor coupled to a negative voltage may become forward-biased by a large amount and may cause functionality and/or power consumption problems.

Figure 5:
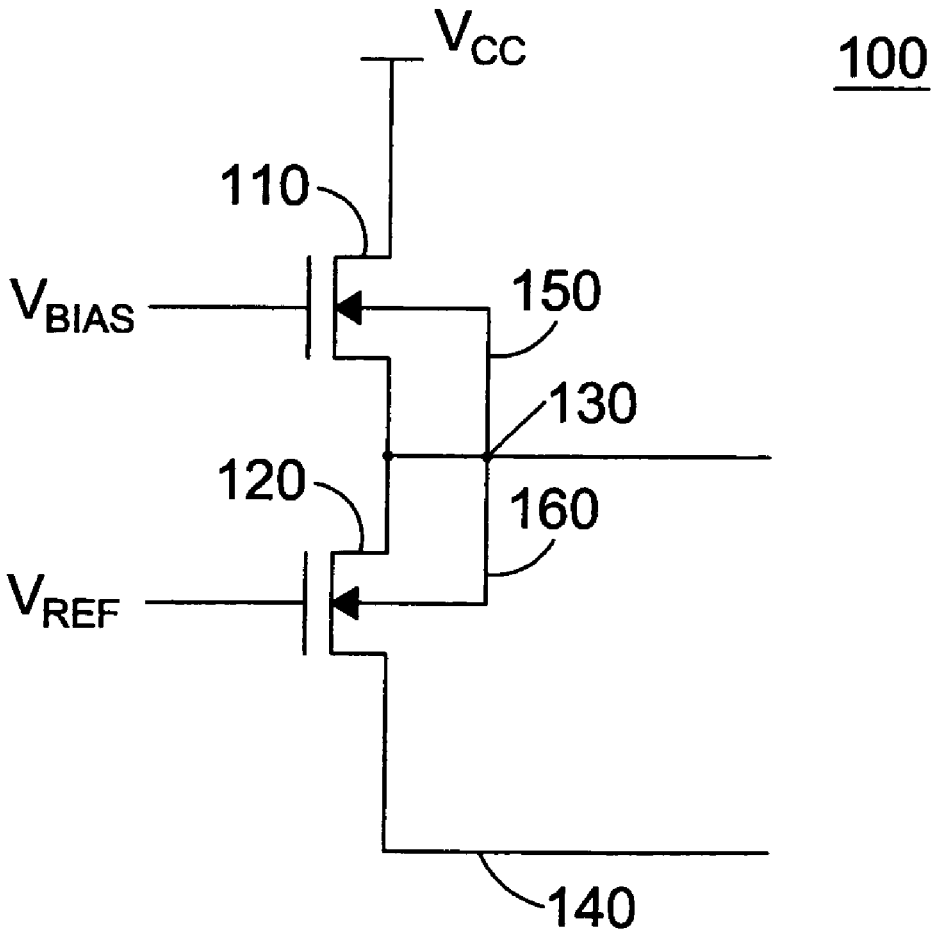
FIG. 5 shows a local bias generator according to an example arrangement.

FIG. 5 shows a local bias generator in accordance with an example arrangement. Other arrangements are also possible. A LBG 100 may be implemented as a single source-follower stage that includes two NMOS transistors 110 and 120, where the source of the transistor 110 is coupled to a drain of the transistor 120 and the gates of these transistors respectively receive the bias and reference voltages $V_{BIAS}$ and $V_{REF}$ output from the central bias generator. A drain of the transistor 110 is coupled to a supply potential $V_{CC}$ and a source of the transistor 120 is coupled to a reference potential (or reference voltage) that may, for example, be ground. The forward body bias voltacie is provided at the node 130 between the transistors 110, 120 and a signal line 140 coupled to the drain of the transistor 120 provides the reference potential (shown as GND) to one or more local functional blocks. The NMOS transistors 110,120 may be arranged to have a dual-well configuration (evident from arrows 150 and 160) in which both transistors 110,120 share the same substrate (i.e., the p-substrate). In this configuration, the transistor body may not be locally tied to the source.

Figure 6:
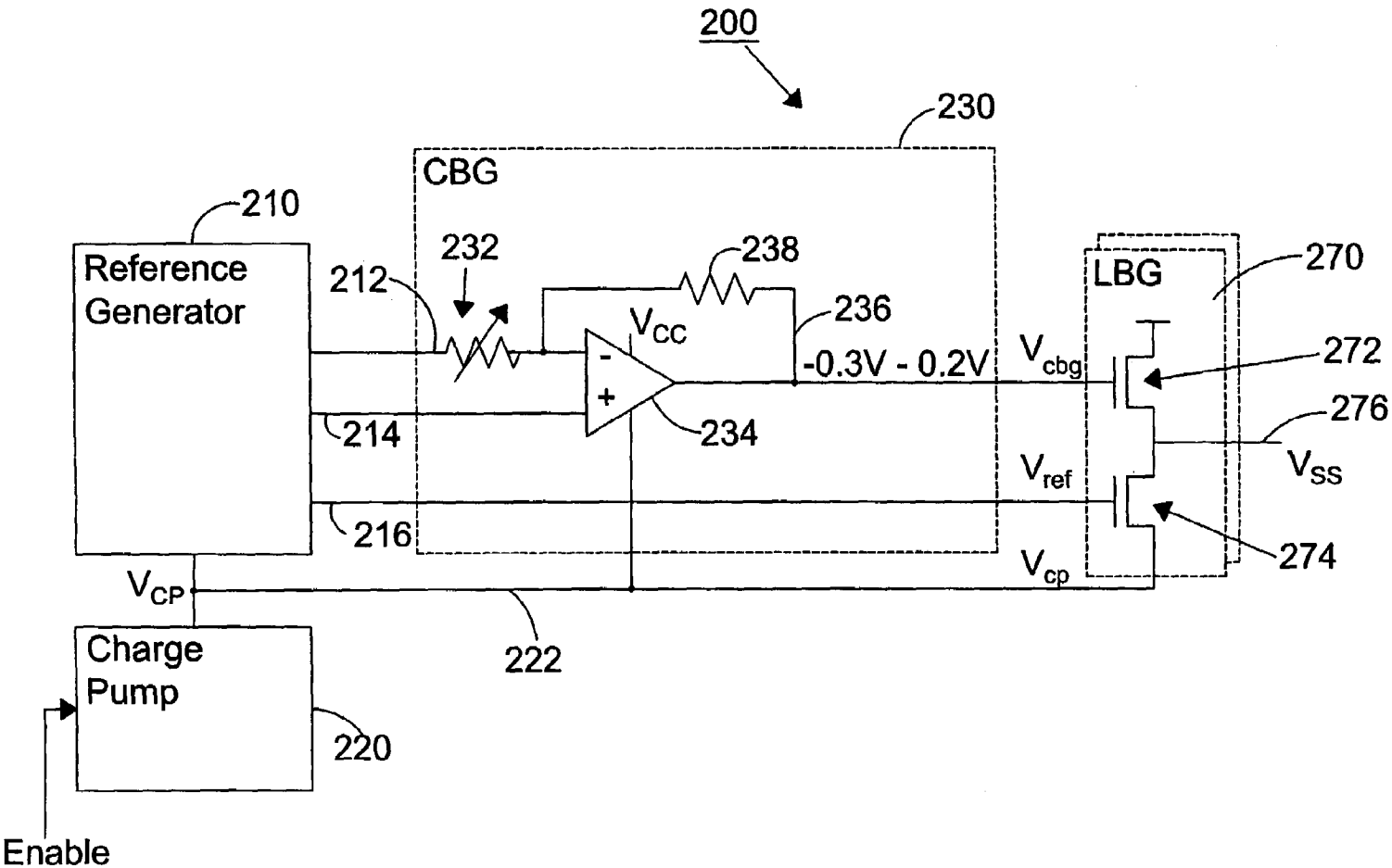
FIG. 6 shows a bias generator for applying forward body bias and reverse body bias according to an example embodiment of the present invention.

FIG. 6 shows a bias generator unit for applying forward body bias and reverse body bias according to an example embodiment of the present invention. Other embodiments and configurations are also within the scope of the present invention. More specifically, FIG. 6 shows a bias generator unit 200 that includes a reference generator 210, a charge pump 220, a central bias generator (CBG) 230 and a local bias generator (LBG) 270. Other local bias generators such as LBG 290 may also be provided to receive signals from the central bias generator 230 and/or other central bias generators. For ease of illustration, the charge pump 220 and the reference generator 210 are shown as separate components, although embodiments of the present limitation are not limited to this configuration. For example, the charge pump 220 and the reference generator 210 may be provided as a single component (such as a charge pump device) or multiple components.

The reference generator 210 may output various signals (such as reference voltage signals) to the central bias generator 230 to be used to provide a proper body bias signal from the LBG 270. For example, the reference generator 210 may output a reference signal (or voltage) along a signal line 212, a reference signal (or voltage) along a signal line 214 and a reference signal (or voltage) along a signal line 216.

The central bias generator 230 may include a variable resistor 232, an operational amplifier 234 and a feedback path 236 that includes a resistor 238. The variable resistor 232 may, for example, be formed from an R-2R resistor network coupled to input a variable reference voltage into an inverting terminal of the amplifier 234. The non-inverting terminal of the amplifier 234 may be coupled to receive a reference signal along the signal line 214 from the reference generator 210. The variable resistor 232 may provide a range of resistances with a given step size (such as determined by a number of legs in a resistor ladder network). The amplifier 234 may be driven by supply voltages $V_{CC}$ and $V_{CP}$, for example. The feedback path 236 may include the resistor 238 that determines an output bias voltage $V_{cbg}$ in combination with the variable resistor 232.

The output of the variable resistor 232 may set the bias voltage $V_{cbg}$ generated by the CBG 230. As this resistance changes, the bias voltage $V_{cbg}$ may change relative to a reference voltage $V_{ref}$ output from the reference generator 210 along the signal line 216. The bias and reference voltages may be output to the LBG 270.

The LBG 270 may receive signals from other components of the bias generator unit 200. For example, the LBG 270 may receive the bias voltage $V_{cbg}$ output from the amplifier 234 of the CBG 230. The LBG 270 may also receive the reference voltage $V_{ref}$ from the reference generator 210 along the signal line 216. Still further, the LBG 270 may also receive a reference voltage (or reference potential) $V_{cp}$ output (or provided) from the charge pump 220 along a signal line 222.

The LBG 270 may be a source-follower design that tracks the bias voltage $V_{cbg}$ with a fixed voltage drop that may be provided by a difference between the reference voltage $V_{ref}$ and the reference potential $V_{cp}$. The embodiment shown in FIG. 6 includes the LBG 270 having NMOS transistors 272 and 274 in which a source of the transistor 272 is coupled to a drain of the transistor 274. The gate of the transistor 272 may receive the bias voltage $V_{cbg}$ from the CBG 230 and a gate of the transistor 274 may receive the reference voltage $V_{ref}$ from the CBG 230. A drain of the transistor 272 may be coupled to a supply voltage $V_{CC}$ and a source of the transistor 274 may be coupled to the reference voltage $V_{cp}$ output (or provided) from the charge pump 220. A node 276 between the transistors 272, 274 may output a body bias voltage $V_{SS}$ to devices (such as transistors) within a function block(s) either on the die or off the die.

The charge pump 220 and the reference generator 210 allow the bias generator unit 200 to be used to apply both forward body bias and reverse body bias to transistors (such as NMOS and PMOS transistors). The reference voltage $V_{cp}$ of the charge pump 220 may be coupled to ground terminals of the CBG 230 and the LBG 270 (as well as other LBGs). Based on the reference voltage $V_{cp}$ output from the charge pump 220, the reference generator 210 outputs voltages along the signal lines 212, 214 and 216. These output voltages may be offset from the reference voltage $V_{cp}$ by different amounts. The amount of offset may be predetermined. In this example embodiment, the offsets from $V_{cp}$ for each of the outputs from the reference generator 210 may be 0.2 volts, 0.7 volts and 1.2 volts. Other offsets are also within the scope of the present invention.

The charge pump 220 may output a reference voltage $V_{cp}$ depending on whether forward body bias or reverse body bias is to be applied. If a forward body bias is desired, an enable input signal to the charge pump 220 may be a certain logic value that results in an output reference voltage $V_{cp}$ of 0.0 volts, for example. On the other hand, if a reverse body bias is desired, the enable input signal to the charge pump 220 may be a different logic value that results in an output reference voltage $V_{cp}$ of −0.5 volts. As one example, the charge pump 220 may be either enabled or disabled based on an input signal to the charge pump.

As a result of the input reference voltage $V_{cp}$, the reference generator 210 may output a reference signal along the signal line 212 having a voltage of approximately ($V_{cp}$+1.2 volts) and the reference generator 210 may output a reference signal along the signal line 214 having a voltage of approximately ($V_{cp}$+0.7 volts). The reference generator 210 may further output a reference signal along the signal line 216 having a voltage of approximately ($V_{cp}$+0.2 volts). Example values of the voltages will be described below with respect to FIGS. 7 and 8.

The first offset (0.2 volts) may represent a drop across the LBG source-follower. This may be in a range of 0.1 volts to 0.4 volts. The difference between the second reference voltage along the signal line 214 and the reference voltage along the signal line 212 may be a maximum amount of body bias to be applied. In this example embodiment, a maximum desired bias may be +/−0.5 volts. The same offset may be required for between the reference voltage on the signal line 214 and the reference voltage on the signal line 216. Different values for the resistors in FIG. 6 may change the voltage on the signal lines 212 and 214.

Figure 7:
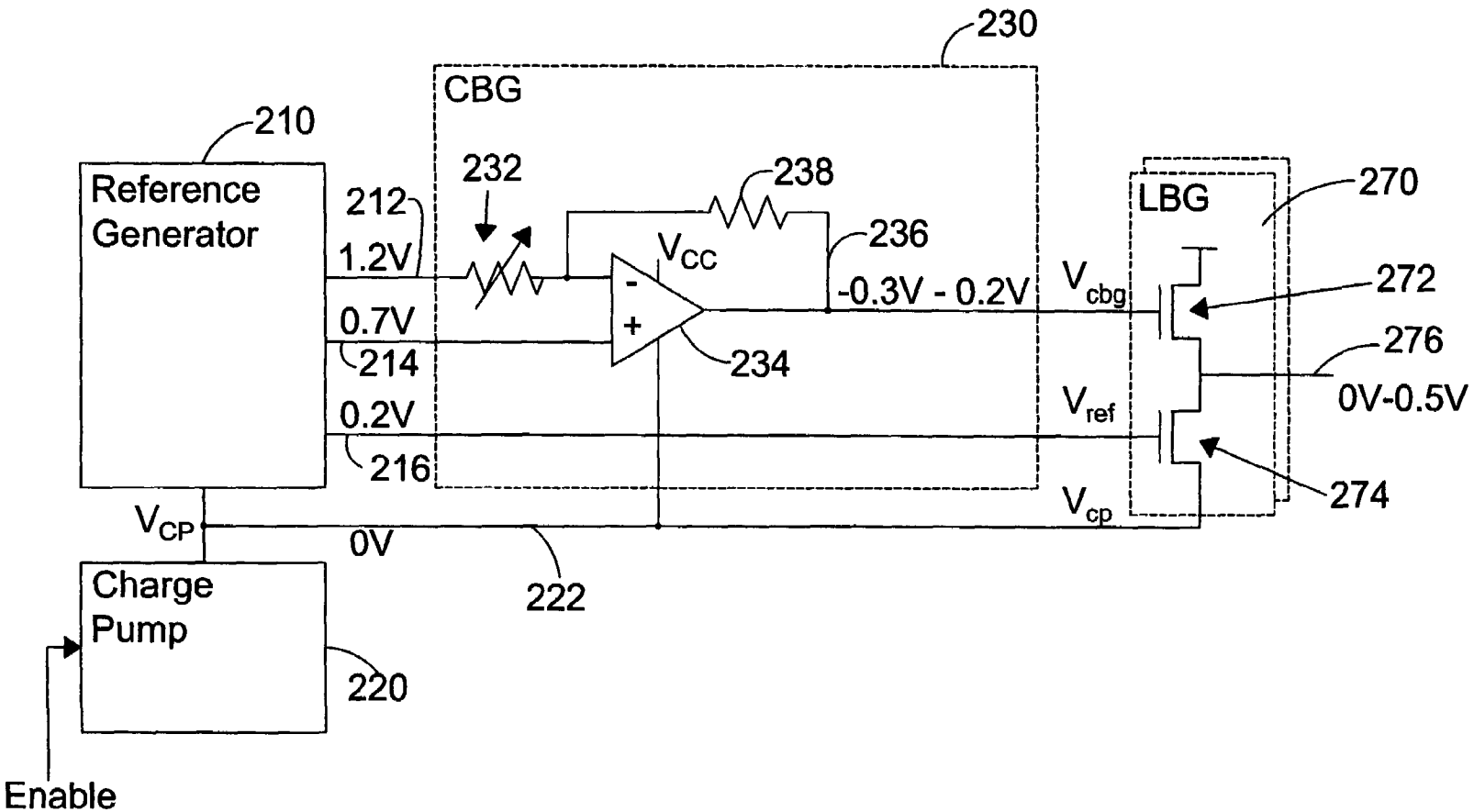
FIG. 7 shows a bias generator applying forward body bias according to an example embodiment of the present invention.

FIG. 7 shows a bias generator unit applying forward body bias according to an example embodiment of the present invention. For ease of illustration, example voltages are shown in FIG. 7. Other embodiments, configurations and voltages are also within the scope of the present invention. More specifically, FIG. 7 shows that based on a logic value of an enable signal, the charge pump 220 outputs (or provides) the reference voltage $V_{cp}$ of 0.0 volts in order to obtain a forward body bias signal from the LBG 270. For example, the charge pump 220 may be disabled and the output $V_{cp}$ is set equal to ground. The output $V_{cp}$ may be applied to a power supply terminal of the amplifier 234 as well as to the source of the transistor 274. As a result of the reference voltage $V_{cp}$, the reference generator 210 outputs a reference signal of approximately 1.2 volts along the signal line 212 (representing $V_{cp}$+1.2 volts). The reference generator 210 also outputs a reference signal of approximately 0.7 volts along the signal line 214 (representing $V_{cp}$+0.7 volts). Additionally, the reference generator 210 outputs a reference signal of approximately 0.2 volts along the signal line 216 (representing $V_{cp}$+0.2 volts). As a result of these signals and the components within the CBG 230, the CBG 230 provides the bias voltage $V_{cbg}$ to the LBG 270 in a range of approximately 0.2 to 0.7 volts. The output body bias voltage Vss of the LBG 270 may thereby vary from approximately 0.0 volts to 0.5 volts due to the varying resistance in the CBG 230.

Figure 8:
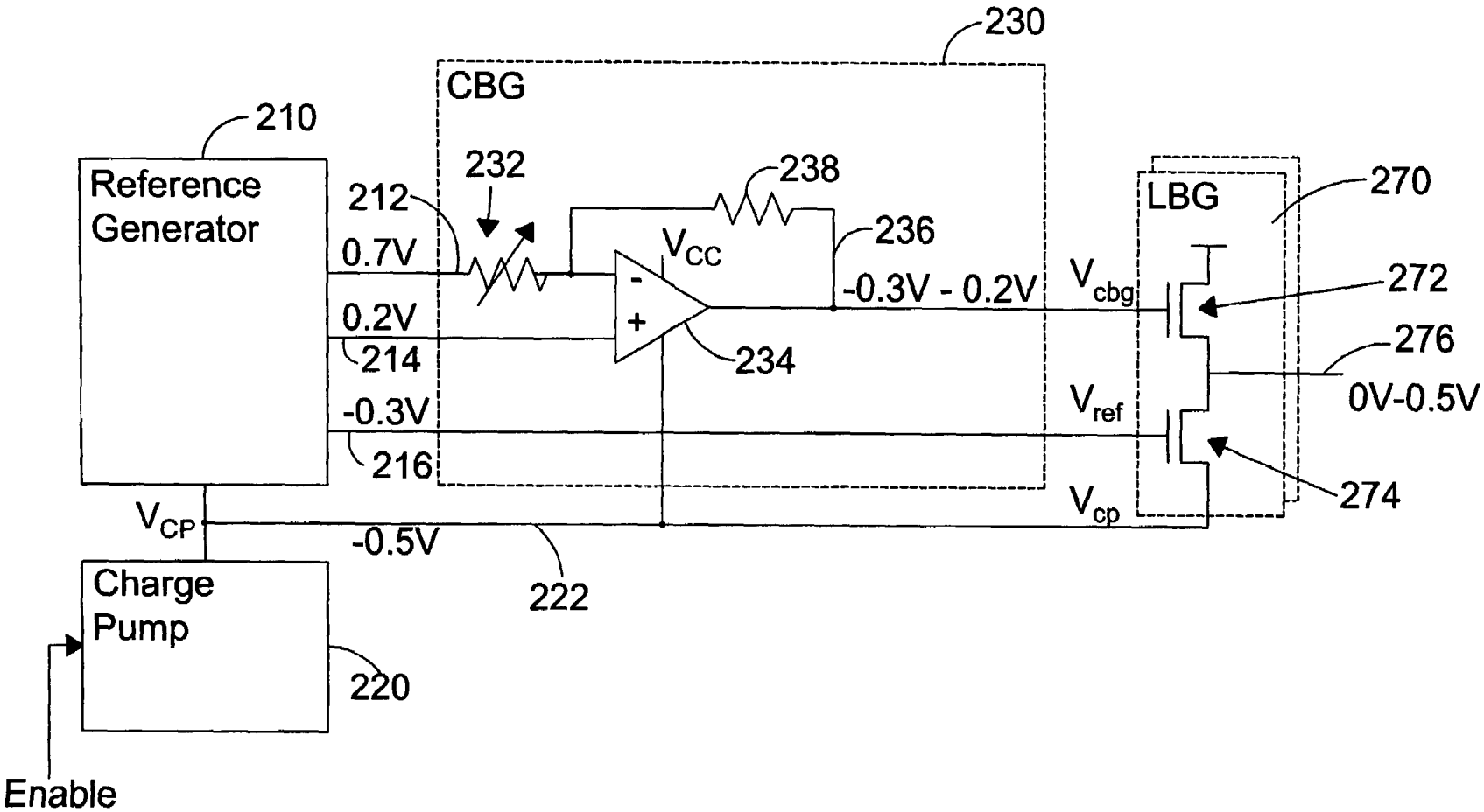
FIG. 8 shows a bias generator applying reverse body bias according to an example embodiment of the present invention.

FIG. 8 shows a bias generator unit applying reverse body bias according to an example embodiment of the present invention. For ease of illustration, example voltages are shown in FIG. 8. Other embodiments, configurations and voltage are also within the scope of the present invention. More specifically, FIG. 8 shows that based on a logic value of an enable signal, the charge pump 220 outputs (or provides) the reference voltage $V_{cp}$ of −0.5 volts in order to obtain a reverse body bias signal from the LBG 270. For example, the charge pump 220 may be enabled and generate an output $V_{cp}$ of −0.5 volts. The output $V_{cp}$ may be applied to a power supply terminal of the amplifier 234 as well as to the source of the transistor 274. As a result of the reference voltage $V_{cp}$, the reference generator 210 outputs a reference signal of approximately 0.7 volts along the signal line 212 (representing $V_{cp}$+1.2 volts). The reference generator 210 also outputs a reference signal of approximately 0.2 volts along the signal line 214 (representing $V_{cp}$+0.7 volts). Additionally, the reference generator 210 outputs a reference signal of −0.3 volts along the signal line 216 (representing $V_{cp}$+0.2 volts). As a result of these signals and the components within the CBG 230, the CBG 230 provides the bias voltage $V_{cbg}$ in a range of approximately −0.3 to 0.2 volts. The output body bias voltage Vss may thereby vary from approximately −0.5 volts to 0.0 volts due to the varying resistance in the CBG 230.

The reference generator 210 ensures that when $V_{cp}$ shifts from 0 volts to −0.5 volts, then all reference voltages along the signal lines 212, 214 and 216 shift at approximately a same time. As a result, the output body bias voltage swings from 0 volts to −0.5 volts as the resistance in the CBG 230 is varied. Therefore, by enabling or disabling the charge pump 220 and by varying the resistance in the CBG 230, any bias voltage from −0.5 volts (i.e., reverse) to 0.5 volts (i.e., forward) may be obtained.

Figure 9:
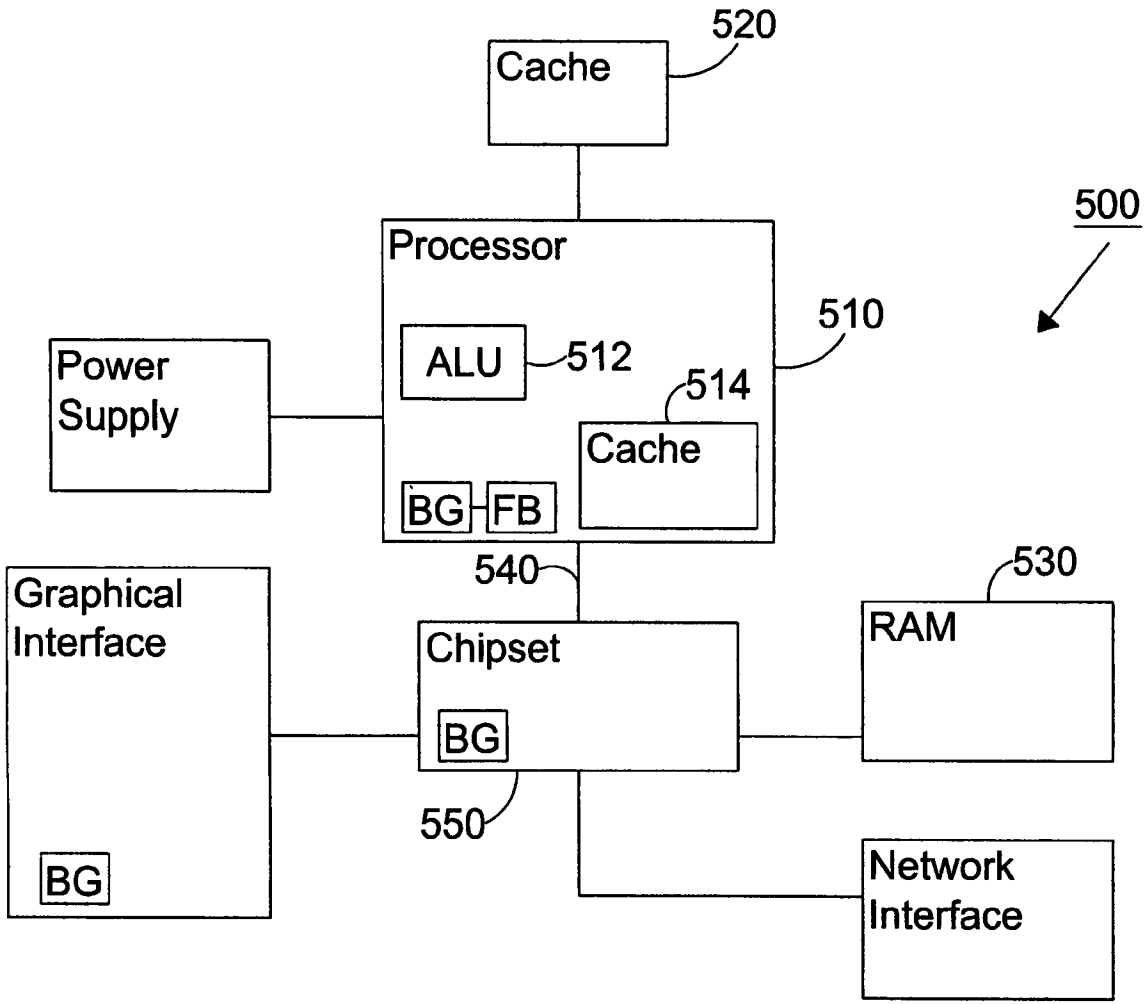
FIG. 9 is a block diagram of a system according to an example embodiment of the present invention.

FIG. 9 is a block diagram of a system (such as a computer system 500) according to an example embodiment of the present invention. Other embodiments and configurations are also within the scope of the present invention. More specifically, the computer system 500 may include a processor 510 that may have many sub-blocks such as an arithmetic logic unit (ALU) 512 and an on-die (or internal) cache 514. The processor 510 may also communicate to other levels of cache, such as off-die cache 520. Higher memory hierarchy levels such as a system memory (or RAM) 530 may be accessed via a host bus 540 and a chip set 550. The system memory 530 may also be accessed in other ways, such as directly from the processor 510 and/or without passing through the host bus 540 and/or the chip set 550. The system memory 530 may also be accessed in other ways, such as directly from the processor 510 and/or without passing through the host bus 540 and/or the chip set 550. In addition, other off-die functional units such as a graphics accelerator and a network interface controller, to name just a few, may communicate with the processor 510 via appropriate busses or ports. The system may also include a wireless interface to interface the system 500 with other systems, networks, and/or devices via a wireless connection.

A bias generator (shown as BG) including a central bias generator, a local bias generator, a charge pump and/or a reference generator may be included in various components of the system 500 (such as the processor 510, the graphical interface and the chip set 550) in order to provide forward body bias and/or reverse body bias in accordance with example embodiments of the present invention. For example, the bias generator may be used to control an operating frequency of the processor and/or may be used to control a reference signal supplied to any of the internal circuits (e.g., functional block FB) of the processor or any circuit coupled thereto.

In the foregoing description, the term "central" is used in connection with the central bias generator only in the sense that an output of the CGB may be distributed to provide forward body bias or reverse body bias, or both, via one or more of the local bias generators, to a number of transistors in the local functional block(s).

In the foregoing description, the local bias generator provides forward body bias and/or reverse body bias to one or more local functional blocks. The local functional blocks may include groups of circuitry (on one or more IC dies) designed to impart a certain logic or mixed signal (analog/digital) functionality to the electrical system embodied within or including generator units. The blocks may be manufactured, for example, using an entirely MOS process in which all of the active devices are FETs, a Bipolar-MOS process in which other transistors in addition to FETs are provided. The MOS process may involve the use of only PMOS or NMOS transistors, or a CMOS process may be implemented in which both transistor types are used. In general, there is some flexibility in the physical placement of the CBG, LBGs, and FUBs. In most advanced CMOS ICs, however, all three components are most likely to be formed on the same IC die for lower cost and better performance.

The functional unit blocks may, for example, include any one or more of the following types of circuits: adders, multipliers, register files, cache memory blocks, control logic, analog blocks such as phase-locked loops, clock generators, and sense amplifiers to name a few, as well as any other type of circuit that may be included in a local functional block on a circuit die.

Systems represented by the various foregoing figures can be of any type. Examples of represented systems include computers (e.g., desktops, laptops, handhelds, servers, tablets, web appliances, routers, etc.), wireless communications devices (e.g., cellular phones, cordless phones, pagers, personal digital assistants, etc.), computer-related peripherals (e.g., printers, scanners, monitors, etc.), entertainment devices (e.g., televisions, radios, stereos, tape and compact disc players, video cassette recorders, camcorders, digital cameras, MP3 (Motion Picture Experts Group, Audio Layer 3) players, video games, watches, etc.), and the like.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments of the present invention have been described with reference to a number of illustrative embodiments thereof, it should be understood that numerous other modifications and embodiments can be devised by those skilled in the art that will fall within the spirit and scope of the principles of this invention. More particularly, reasonable variations and modifications are possible in the component parts and/or arrangements of the subject combination arrangement within the scope of the foregoing disclosure, the drawings and the appended claims without departing from the spirit of the invention. In addition to variations and modifications in the component parts and/or arrangements, alternative uses will also be apparent to those skilled in the art.

What is claimed is:

1. A bias generator comprising:

a central bias generator to provide a bias voltage;

a local bias generator to receive the bias voltage and to provide at least a body bias signal; and a charge pump device to apply at least one first reference singnal to the central bias generator and to apply at least second reference signal to the local bias generator so as to control the body bias signal provided by the local bias generator, the at least one first reference signal to vary between at least two values based on a desired body bias of the local bias generator and the at least one second reference signal to vary between at least two values based on the desired body bias of the local bias generator.

2. The bias generator of claim 1, wherein the at least second reference signal to apply to a gate of a transistor within the local bias generator.

3. The bias generator of claim 1, wherein the body bias signal comprises a reverse body bias signal.

4. The bias generator of claim 3, wherein the local bias generator comprises a first transistor and a second transistor to convert the bias voltage into the body bias signal.

5. The bias generator of claim 4, wherein the first transistor and the second transistor each comprise an n-type metal oxide semiconductor (NMOS) transistor.

6. The bias generator of claim 4, wherein the at least second reference signal includes a first signal and a second signal, the first signal to apply to a gate of the second transistor, and the second signal to apply to a source of the second transistor.

7. The bias generator of claim 1, wherein the charge pump device includes a charge pump and a reference generator coupled to the charge pump.

8. The bias generator of claim 7, wherein the charge pump controls an input to the reference generator in order for the local bias cienerator to provide a reverse body bias signal or a forward body bias signal.

9. The bias generator of claim 7, wherein the central bias generator includes:

an amplifier having at least an input and an output; and a feedback loop coupled between the output and the input of the amplifier.

10. The bias generator of claim 7, wherein the local bias generator includes a single-stage source-follower circuit to generate the body bias signal for a functional block.

11. The bias generator of claim 10, wherein the single-stage source-follower circuit includes a first transistor and a second transistor having a node coupled between the first transistor and the second transistor, the node providing the body bias signal to the functional block.

12. An apparatus comprising:

a first bias generator;

a second bias generator having a plurality of transistors to provide a reverse body bias signal or a forward body bias signal based on inputs to the second bias generator; and a charge pump device coupled to the first bias generator and the second bias generator, the charge pump device to allow different potentials to be applied to the second bias generator from the first bias cienerator and to allow different potentials to be applied to the second bias generator from the charge pump device so as to provide the reverse body bias signal or the forward body bias signal.

13. The apparatus of claim 12, wherein the plurality of transistors includes a first NMOS transistor and a second NMOS transistor.

14. The apparatus of claim 12, wherein the charge pump device includes a charge pump and a reference generator coupled to the charge pump.

15. The apparatus of claim 14, wherein the charge pump controls an input to the reference generator in order for the second bias generator to provide the reverse body bias signal or the forward body bias signal.

16. The apparatus of claim 14, wherein the second bias generator includes a single-stage source-follower circuit to generate either the reverse body bias signal or the forward body bias signal for a functional block.

17. The apparatus of claim 16, wherein the single-stage source-follower circuit includes a first transistor and a second transistor having a node coupled between the first transistor and the second transistor, the node providing either the reverse body bias signal or the forward body bias signal to the functional block.

18. The apparatus of claim 14, wherein the first bias generator includes:

an amplifier having at least an input and an output; and a feedback loop coupled between the output and the input of the amplifier.

19. The apparatus of claim 12, further comprising a functional block unit to receive the reverse body bias signal or the forward body bias signal.

20. The apparatus of claim 19, the apparatus comprises a die.

21. The apparatus of claim 12, wherein the different potentials are applied to a gate of one of the transistors within the second bias generator.

22. The apparatus of claim 12, wherein a first signal is applied to a gate of one of the transistors, and a second signal is applied to a source of one of the transistors.

23. An electronic system comprising:

a wireless interface device to send or receive signals;

a processor to process signals; and a power supply to supply power to the processor, the processor including a body bias circuit having:

a central bias generator to provide a bias voltage;

a local bias generator to receive the bias voltage and a reference voltage and to provide at least a body bias signal based on the bias signal and the reference voltage; and a device to apply at least one first reference signal to the central bias generator and to apply at least one second reference signal to the local bias generator so as to control the body bias signal provided by the local bias generator, the at least one first reference signal to vary between two values based on a desired body bias of the local bias generator and the at least one second reference signal to vary between two values based on the desired body bias of the local bias generator.

24. The electronic system of claim 23, wherein the device includes a charge pump and a reference generator coupled to the charge pump.

25. The electronic system of claim 24, wherein the charge pump controls an input to the reference generator in order for the local bias generator to provide a reverse body bias signal or a forward body bias signal.

26. The electronic system of claim 23, wherein the at least second reference signal is applied to a gate of a transistor within the local bias generator.

27. The electronic system of claim 23, wherein the at least second reference signal includes a first signal and a second signal, the first signal to apply to a gate of the second transistor, and the second signal to apply to a source of the second transistor.

* * * * *

UNITED STATES PATENT AND TRADEMARK OFFICE

CERTIFICATE OF CORRECTION

PATENT NO. : 7,164,307 B2
APPLICATION NO. : 11/038134
DATED : January 16, 2007
INVENTOR(S) : James W. Tschanz et al.

It is certified that error appears in the above-identified patent and that said Letters Patent is hereby corrected as shown below:

Column 9:
Claim 1, line 51, change “singnal” to --signal--;

Column 10:
Claim 8, line 14, change “cienerator” to --generator--;

Column 10:
Claim 12, line 38, change “cienerator” to --generator--; and

Column 11:
Claim 20, line 4, after “19,” insert --wherein--.

Signed and Sealed this

Third Day of April, 2007

JON W. DUDAS
*Director of the United States Patent and Trademark Office*